United States Patent [19]

Sarda

[11] Patent Number: 4,815,376

[45] Date of Patent: Mar. 28, 1989

[54] PRESS FOR SHEET FED OR WEB PRINTING

[76] Inventor: Jean-Claude Sarda, 48 Avenue Claude Vellefaux, Paris, France, 75010

[21] Appl. No.: 154,332

[22] Filed: Feb. 10, 1988

[30] Foreign Application Priority Data

Feb. 10, 1987 [FR] France ..... 87 01635

[51] Int. Cl.[4] ..... B41F 7/08; B41F 17/08

[52] U.S. Cl. ..... 101/177; 101/232; 101/228

[58] Field of Search ..... 101/136, 137, 138, 139, 101/140, 141, 142, 143, 145, 175, 176, 177, 182, 183, 184, 185, 217, 218, 219, 225, 228, 232, 91, 92

[56] References Cited

U.S. PATENT DOCUMENTS 3,897,727 8/1975 Fulk ..... 101/228 X 4,328,749 5/1982 Inouye et al. ..... 101/176 X

*Primary Examiner*—J. Reed Fisher

*Attorney, Agent, or Firm*—James E. Bradley

[57] ABSTRACT

Offset printing press which comprises, in combination, a set of means making it possible for it to carry out, either independently or simultaneously, sheet-fed or web-fed printing. These webs are presented equally well either as perforated and prefolded pages or as reels. A set of mechanical movement pieces, working together with the removable components, makes it possible, depending on the types of printing to be carried out, to provide the press with twenty possibilities of different printing modes. A movable press-cylinder 17 (FIG. 3), working together with the blanket of the removable blanket cylinder 3A, makes it possible to prevent the web-fed printed matter, during its printing, from passing through the press and, by so doing, to make these two modes of feeding and printing, sheet-fed and web-fed, totally independent of each other. The same type of removable device as that fitted on the mixed press, also mounted on a sliding frame 64 (FIG. 4), can be fitted on a set of existing sheet-fed offset presses, in order to make it possible for them to carry out successive sheet-fed and web-fed printing.

4 Claims, 8 Drawing Sheets

PRESS FOR SHEET FED OR WEB PRINTING

FIELD OF THE INVENTION

The object of the present invention is the creation of offset printing presses which are designed on the basis of sheet-fed presses, modified, and provided with a set of complementary means making it possible for them to carry out simultaneous or successive sheet-fed or web-fed printing.

DESCRIPTION OF THE PRIOR ART

At present, web-fed printing is carried out on very large printing units which are well adapted, with their high speeds, to large runs, but whose means of implementation are lengthy and disproportionate to the printing of short runs.

Moreover, the rapid development in microcomputing as well as the fall in its production costs mean that mary average-sized firms are becoming computerized. This has created new requirements for web-fed printed matter in short and medium runs, to which requirements the traditional printers, equipped for the most part with sheet-fed presses, cannot respond.

The manufacturers of offset presses, aware of this new market, are beginning to produce, in relatively small quantities, appliances better adapted to this requirement. However, their lack of versatility added to the fact that their prices, compared to similar sheet-fed equipment, are approximately threefold makes it difficult for them to recoup their costs at the present stage of development of this new process. Moreover, these presses are designed solely for printing forms or labels intended for computing and cannot process web-fed printed matter not equipped with "caroll" punches, since their system for driving the web and for marking the margin are connected to the holes of these punches.

Now, in the field of printing from a non-punched web with short or medium runs, such as for example labels, a huge market exists which completely escapes the traditional printer possessing only sheet-fed offset presses.

Moreover, these presses are not easy for the user to employ, since their design derives directly from sheet-fed presses and, for this reason, they are poorly adapted to web-fed printing. As is shown in FIG. 1, the operator of these presses is forced to feed and to introduce the continuous web 1, prefolded into pages, into the drives 2, then to pass it through the blanket 3 and impression 4 cylinders, to take it out in order to introduce it into the outlet drives 2A and to forward it into the folder 5 as far as the receiving stack 6.

The start-up and operation of the machine, in this design, is not convenient for the operator, and this is all the more difficult when prefolded and transversely preperforated webs of light paper are being processed, in which case the risks of tearing are quite frequent and, in this case, make it necessary to carry out the same advance of the web again.

Another major shortcoming of these presses lies in the fact that they do not make it possible to carry out, when required and simultaneously, numbering on printed matter intended for the production of bundles of a large number of numbered pages.

SUMMARY OF THE INVENTION

The object of the present invention, as described in its various claims, is to overcome all these disadvantages by providing the sheet-fed presses with complementary means working together with their main components, so as to make it possible to carry out, simultaneously or successively, both sheet-fed or web-fed printing from webs with or without "caroll" punches.

The numbering unit fitted on these presses serves two purposes and makes it possible for numbering to be carried out equally well either sheet-fed or web-fed. The advantages obtained by means of this invention consist in providing the traditional printers with a substantially versatile printing press which is convenient to use and whose series-production cost will be appreciably higher than that of a sheet-fed press of the same capacity. The basic machine will be supplied in the version chosen by the customer and will comprise the set of components indispensable for driving the removable complementary components which it will be possible to add as and when needed. In order to allow the printer to change quickly from one version to another, each device is grouped together on a support taking the form of a sliding frame.

DESCRIPTION OF THE PREFERRED EMBODIMENT

The invention is described in detail hereinafter with reference to the drawings attached to the text and showing one of the preferred embodiments of the different versions.

Figure 1:
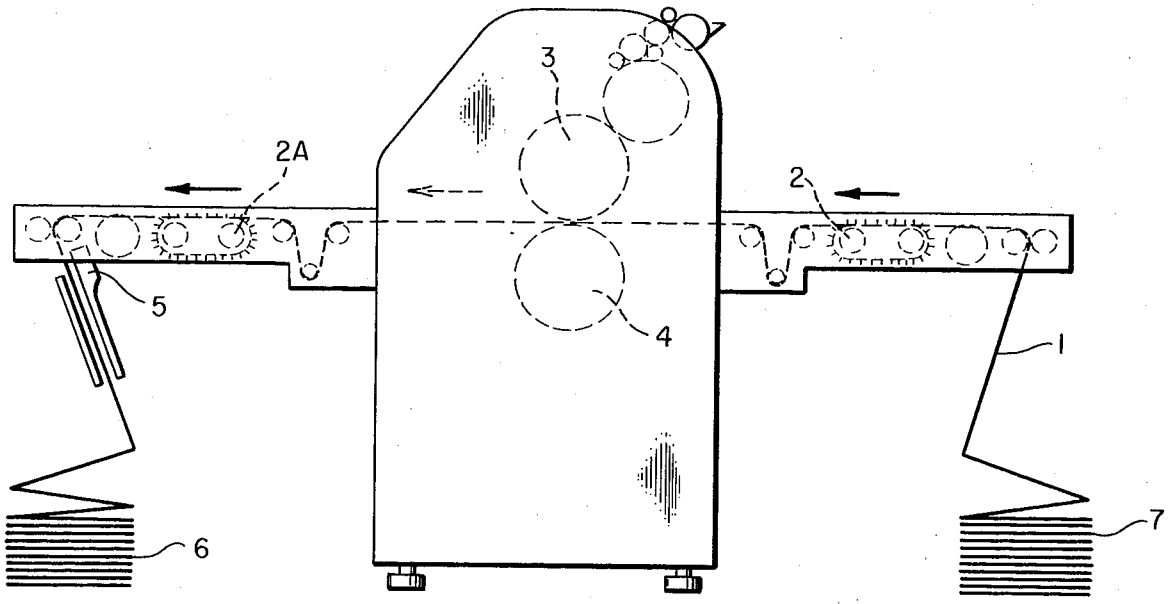
Figure 2:
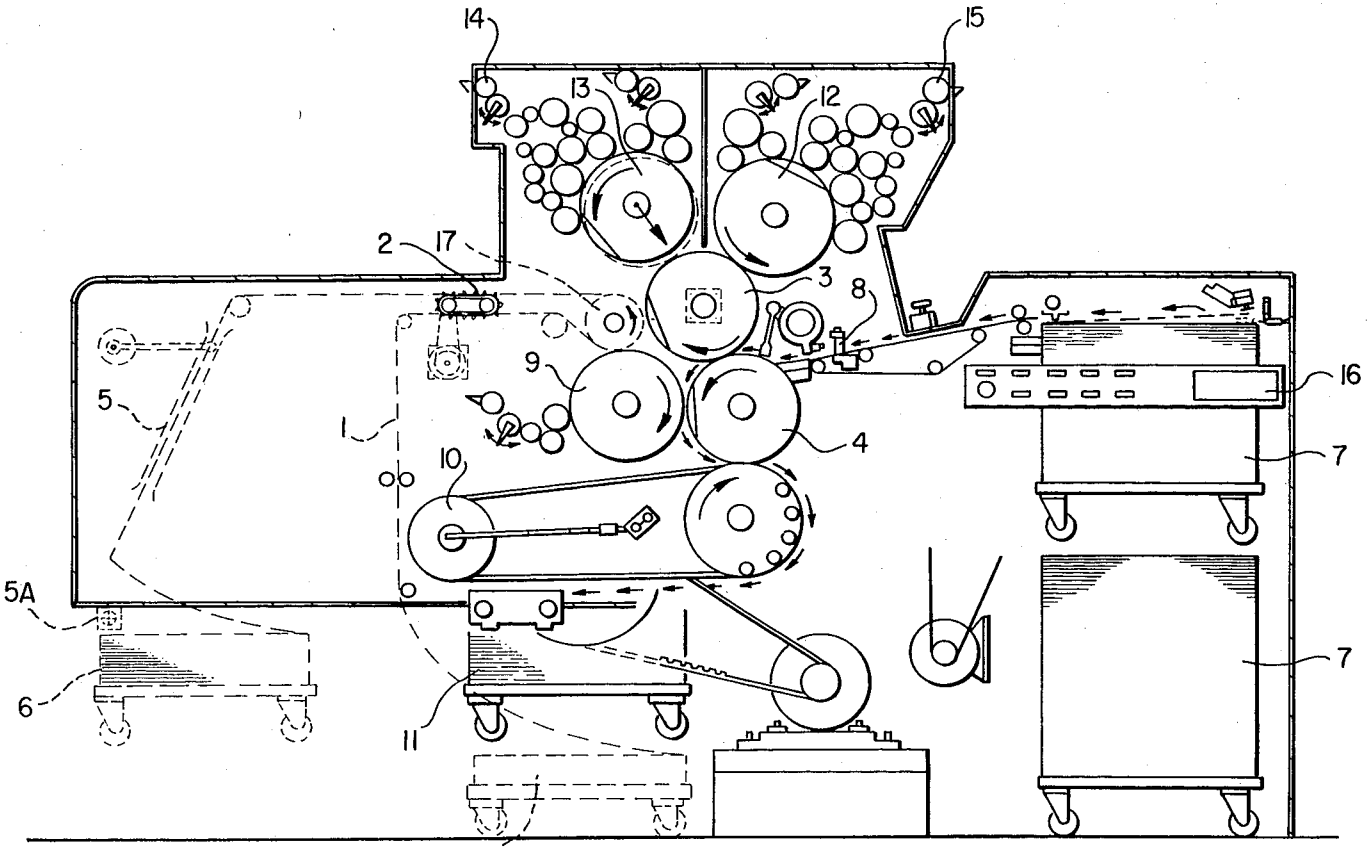

FIG. 2 shows a front view of a sheet-fed press, in which the arrangement of the different components has been chosen in such a way that it is possible to obtain, in each printing cycle, successively sheet-fed or web-fed, printed matter which may comprise two off-set colors plus a numbering in a third typographic color.

In the sheet-fed version, the sheet of paper is removed from the stack 7 (FIG. 2) and forwarded in the direction of the arrows towards the traditional feeding device 8, as far as the impression cylinder 4 where the grips catch it and press it successively against the blanket covering the blanket cylinder 3 and the numbering units arranged on their circular support 9 at the outlet from the impression cylinder 4. The grips open and the sheet is taken up by the grips of the outlet chain conveyor 10 which forward it and set it down on the receiving stack 11. The plate cylinders 12 of the main printing unit and of the movable support unit 13 print, before and during each printing cycle, their image on the blanket of the blanket cylinder 3. The inking of the offset plates comprising the image to be reproduced is carried out by the set of inking and damping rollers constituting their respective inking units 14 and 15.

In the version of web-fed printing, the advance of the web has been preferably modified in order to allow the operator of the press to work only on one side of it. This arrangement makes it possible, by using all the components in the press, including the numbering unit, to obtain a printed matter having, in each printing cycle, two colors and a numbering, in the same way as with sheet-fed printing (FIG. 2).

Before printing, the sheet-feeding is put out of operation by means of a pneumatic valve which closes the inlet of air caused by the absence of sheets under the air inlets of the feeder. The stack of paper pre-folded in the form of a blank page 11A is placed on its pallet on the floor. The top of the web 1 is unrolled, guided and brought under the bottom of the group of pin drives 2 which secure it by means of swinging flaps. It then passes around the complementary and removable impression cylinder 17 which will allow it to be pressed against the numbering unit 9 and the blanket cylinder 3 which will have received, as in sheet-fed printing, its print in one or two colors from the plate cylinder or cylinders 12 and 13. In this specification, the removable impression cylinder 17 is also referred to in an abbreviated fashion as the "press cylinder 17", and "impression cylinder 17".

The printed web is slightly tightened, guided and driven by the top of the pin drives 2 whose spacing corresponds to that of the "caroll" punches (½ inch).

Figure 8:
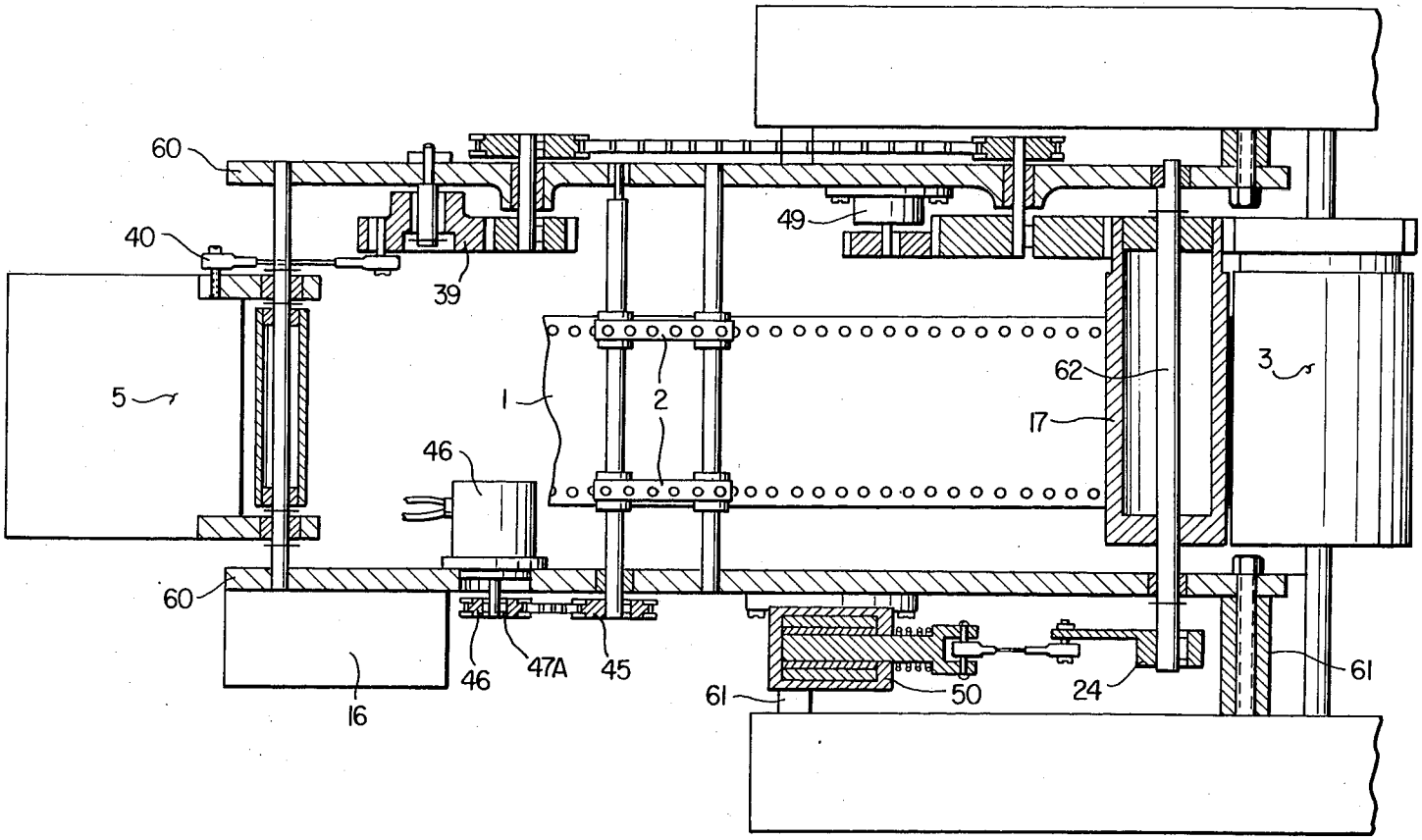

In each of the examples which follow, with the exception of FIG. 8 which shows an accessory device to be fitted on a conventional sheet-fed press, the movement pieces for rotating the impression cylinder 17 and the folder 5 are included in the general mechanism of the press. Depending on the work to be carried out, either on a web with "caroll" punches or on a web with marks to be printed, the removable components are arranged on a sliding frame 64 (FIG. 4) sliding and locked on slide rails 65. The punched web of paper 1 (FIG. 3) to be printed is wound around the movable press-cylinder 17 and can be pressed against the blanket cylinder 3A by the action of the two eccentric bearings 18 (FIG. 4) appropriately adjusted.

Figure 3:
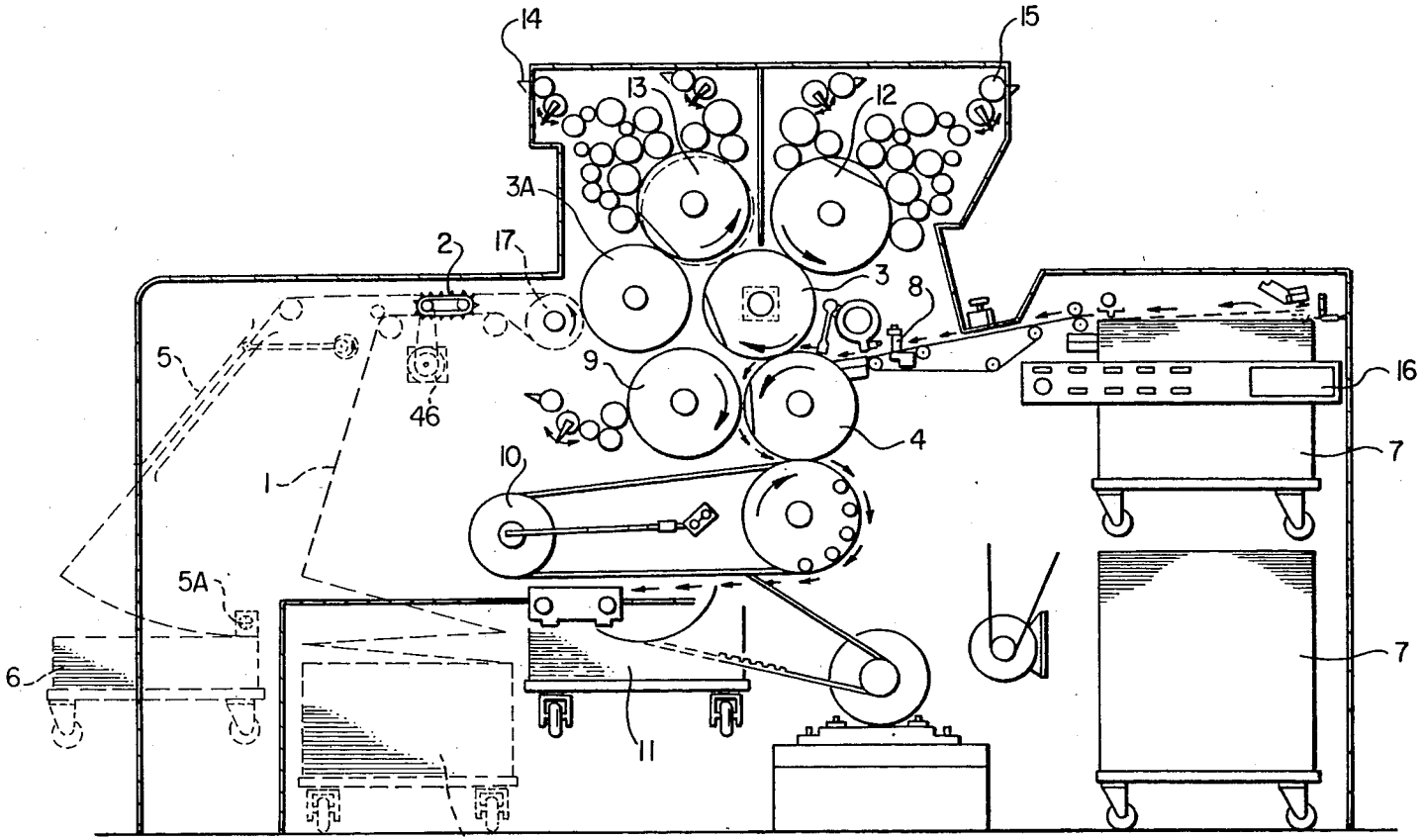

FIG. 3 shows a front view of the printing press working simultaneously, on the one hand with sheet-fed printing from the pallet for feeding blank sheets 7 and, on the other hand, with web-fed printing from the pallet of prefolded blank paper 11A.

Figure 4:
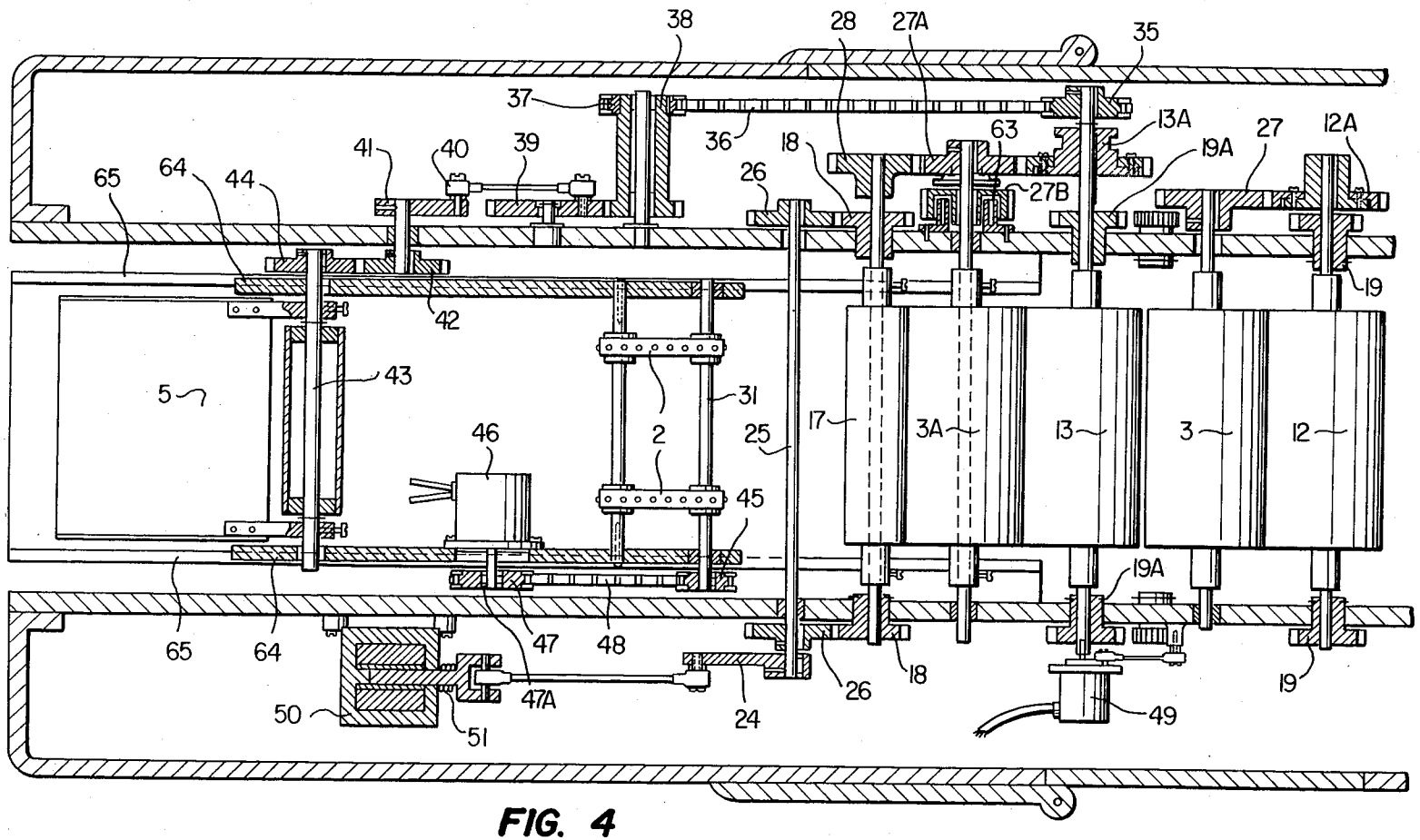

FIG. 4 shows a mechanical arrangement, preferably retained, making it possible to carry out simultaneous sheet-fed and web-fed printing. Sheet-fed printing involves the inking unit 15 (FIG. 3), the plate cylinder 12, the blanket cylinder 3, the impression cylinder 4, the numbering cylinder 9, the chain conveyor 10, the sheet-feeding stack 7 and the stack for receiving the printed sheets 11. The sheet-fed section operates as a conventional machine.

Web-fed printing involves the inking unit 14 (FIG. 3), the plate cylinder 13, the removable blanket cylinder 3A, the impression cylinder 17 the stack 11A for feeding prefolded paper and the stack 6 for receiving the printed and refolded paper. The displacement towards gear 27A (FIG. 4) fitted on the shaft of the blanket cylinder 3A, of the sliding gear 13A, activated by a hand-lever (not shown for reasons of clarity) uncouples the plate cylinder 13 from the cylinders 3 and 12 used for sheet-fed printing. In contrast, this movement of the gear 13A permits use of the inking unit 14 (FIG. 3) and of the plate cylinder 13 (FIG. 4) being moved by the rotation of its eccentric bearings 19A in order to carry out printing together with the blanket cylinder 3A and the press-cylinder 17 which are removable and appropriately positioned. The rotational movement originating from the common motor of the machine drives the gear 27 (FIG. 4) fastened on the shaft of the blanket cylinder 3 and the free gear 27B in rotation on the shaft of the blanket cylinder 3A by means of intermediate gears (not shown in order to improve understanding of the drawing). When it is supplied with electrical current, the electromechanical clutch 63 drives the blanket cylinder 3A and the impression cylinder 17 by means of the common motor of the printing press. The drive chains with pins 2 are driven by a grooved shaft 31 at the end of which an indexed pinion 45 is fastened. A step motor 46 drives the indexed pinion 45 by means of the indexed pinion 47 and the indexed belt 48.

The step motor 46 receives its pulses from an electronic casing 16 (FIG. 3) comprising a key unit or coding wheels capable of programming the length of the format to be printed. The pulse generator 49 (FIG. 4) enables the electronic casing 16 (FIG. 3) to calculate the speed of the step motor 46 as a function of the speed of the plate cylinder 13. Moreover, the pulse generator 49 (FIG. 4) supplies the electronic casing 16 (FIG. 3) with a synchronizing signal at each turn of the plate cylinder 13. At this signal, the electronic casing 16 (FIG. 3) supplies current to the electromagnet 50 (FIG. 4). The lever 24 drives the shaft 25 and the gears 26 which are fastened to it. The eccentric bearings 18 begin to rotate and bring about the "pressure" position of the press-cylinder 17 while it is still facing the hollow of the blanket cylinder 3A. At the same time the step motor 46 starts and moves the web of punched paper at the same speed as the circumferential speed of the blanket cylinder 3A. When the hollow of the blanket cylinder 3A has unwound, the press-cylinder 17 exerts pressure. The printing of the programmed format is achieved. At this moment, the programmed electronic casing 16 (FIG. 3) sends a signal for ending pressure. The electromagnet 50 (FIG. 4) is released, and the spring 51 provides the movement for ending pressure by turning the eccentric bearings 18 of the impression cylinder 17. When this movement has been completed, the electronic casing 16 (FIG. 3) stops the step motor 46, then reverses its direction of rotation by a length programmed as a function of the format to be produced which will then be obtained by the difference between the run of the web in the direction of the printing and the reverse run. It should be noted that the step motor 46 could be replaced by a direct-current motor and an associated electronic assembly. This is a known process for controlled displacement by an electronic monitoring device. A balance folder 5 ensures refolding of the printed web. An indexed pinion 35 is fastened on the shaft of the plate cylinder 13. The indexed belt 36 drives the indexed pinion 37 which is integral with the gear 38. The latter sets the crank gear 39 in rotation at half speed. The connecting rod 40 retransmits the movement to the folder 5 by means of the lever 41 integral with the gear 42 which oscillates while driving the gear 44 fixed on the shaft 43 of the folder 5. Therefore, to each turn of the plate cylinder 13, thus to each printed format, there corresponds a forward or return movement of the folder 5 ensuring refolding.

Figure 5:
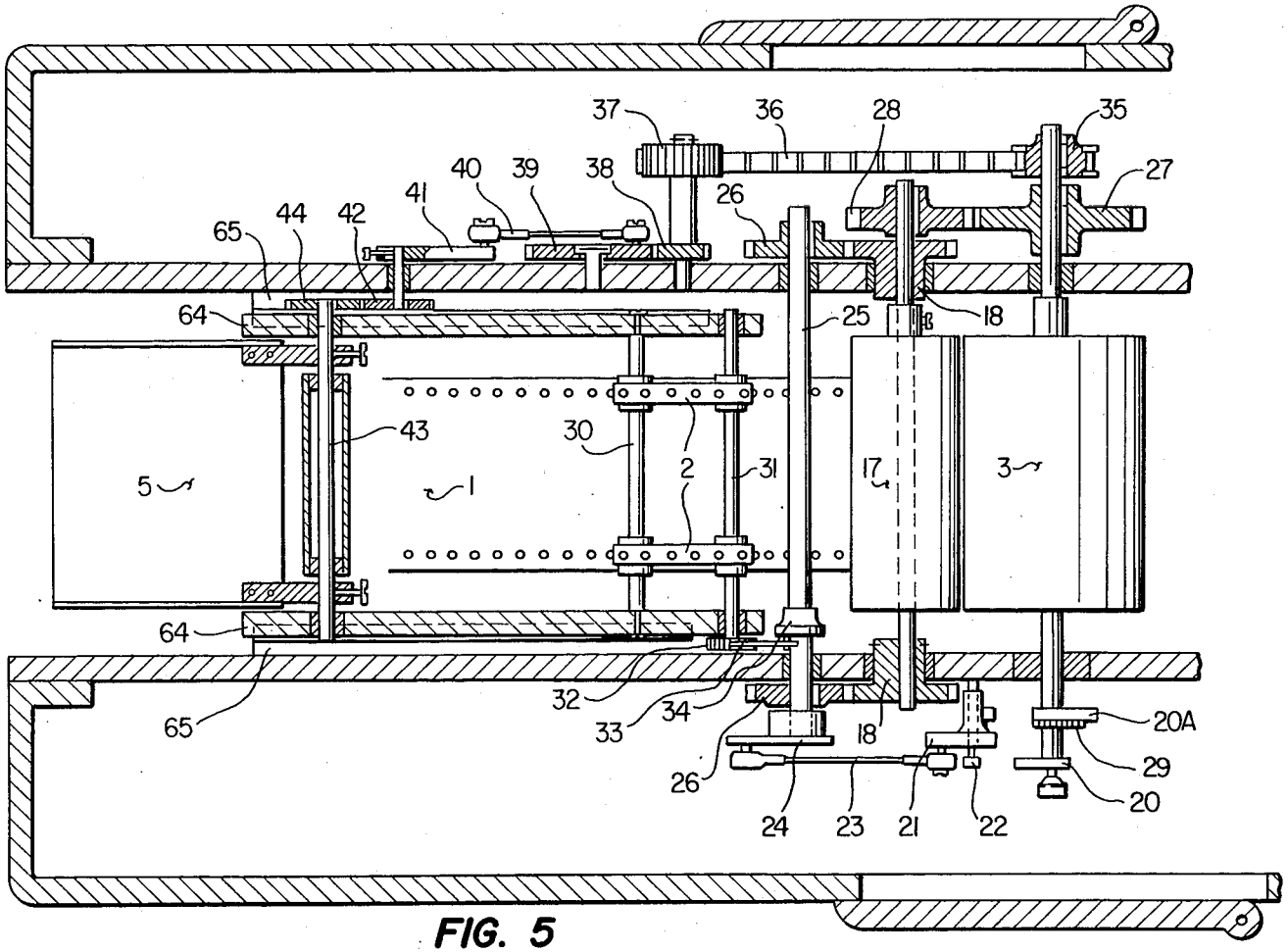

FIG. 5 shows a plan view with the drives 2 being controlled in a completely mechanical manner. The shaft of the blanket cylinder 3 carries, at one end, a set of adjustable cams 20 and 20A which swing the lever 21 either in one direction or in the other by means of the cam rollers 22. The connecting rod 23 in turn activates the lever 24 which, fastened on the shaft 25, drives it in its oscillation as well as the two gears 26 in gear with the two eccentric bearings 18 in which the shaft of the press-cylinder 17 turns. There are thus obtained, at each turn of the blanket cylinder 3, a pressure position followed by a position ending pressure controlled by the maneuvering cams 20 and 20A, and this at each rotation of the blanket cylinder 3, thus at each printing cycle. The gear 27 fastened on the shaft of the blanket cylinder 3 is in gear with the gear 28 fastened on the shaft of the impression cylinder 17, thus ensuring rotation of the latter, even during the part of the cycle when there is no pressure. The cam for causing pressure 20 always triggers pressure in the hollow of the blanket cylinder. The cam for ending pressure 20A triggers the end of pressure at will, depending on the chosen format to be printed, engraved on the vernier 29. The web of paper 1, printed by the pressure between the blanket cylinder 3 and the press-cylinder 17, drives the chain drives with pins 2 supported by the adjustment shaft 30 and the grooved shaft 31 one end of which comprises a fastened ratchet wheel 32. A catch 33 articulated on the lever 34 set in motion by the shaft for controlling the pressure 25 drives, in a small backward movement, the web of paper 1 each time the pressure is ended, thus smoothing the web in order to obtain the appropriate format after each printing cycle. The format printed will thus be defined by the difference between the length of web printed by the impression cylinder 17 adjusted by the cam 20A, chosen on the vernier 29, and the return movement due to the catch 33 which will be variable as a function of the number of teeth cut on the wheel 32. Thus, it will be possible to choose a format to be printed with a spacing of half an inch, a sixth of an inch or an eighth or an inch. During pressure, the catch 33 comes out from the toothed wheel 32, thus ensuring the free rotation of the drives 2 driven by the punched web of paper 1.

In the case where printing is carried out from a web of light paper, it is preferable, in order to avoid the risks of tearing the web, to drive the drives mechanically in phase with the machine.

A folder 5 ensures refolding of the printed web. An indexed pinion 35 is fastened on the shaft of the blanket cylinder 3. The indexed belt 36 drives the indexed pinion 37 which is integral with the gear 38. The latter ensures rotation of the crank gear 39 at half speed. The connecting rod 40 retransmits the movement to the folder 5 by means of the lever 41 which is integral with the gear 42 which sets the shaft 43 of the folder in oscillation, on which shaft the gear 44 is fastened.

Figure 6:
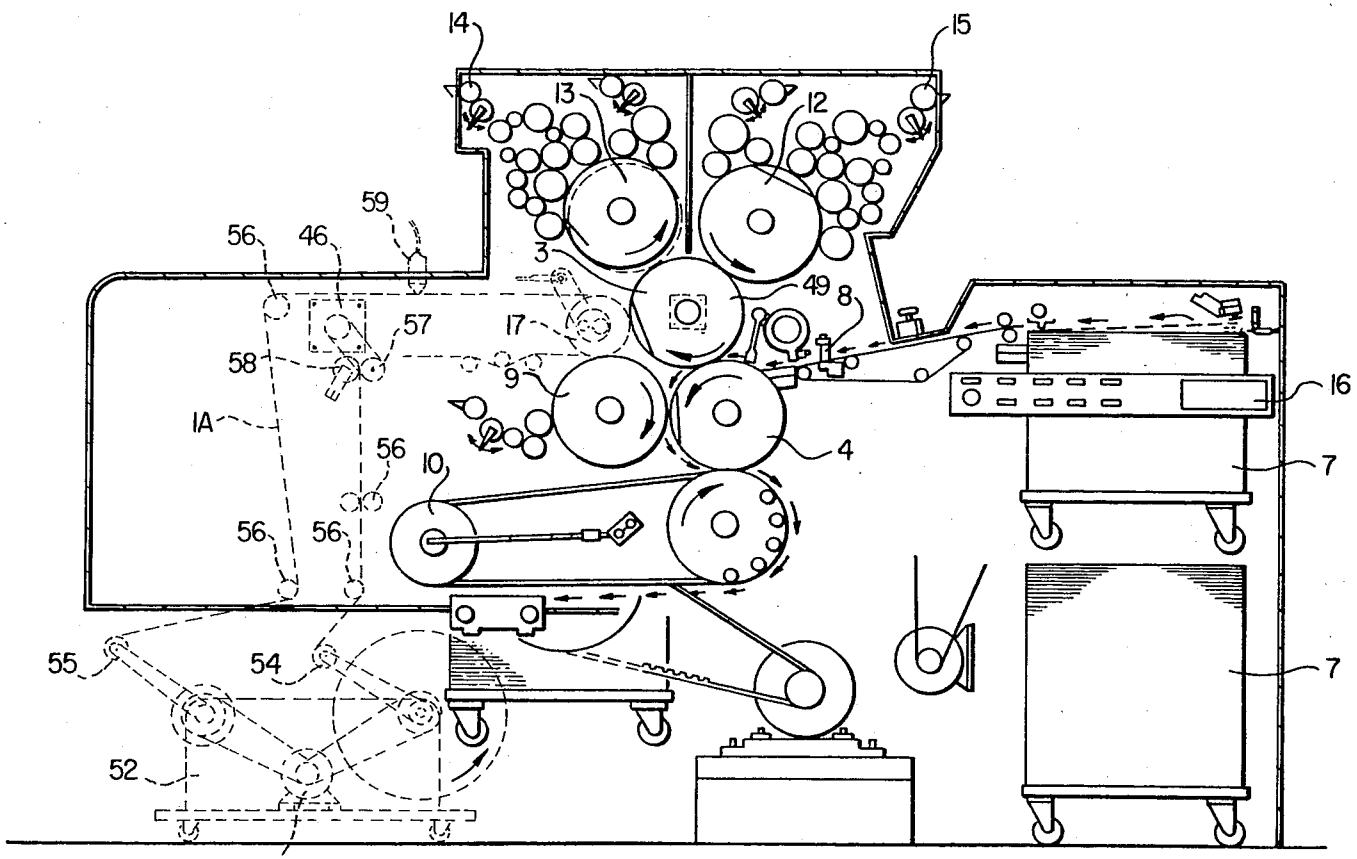
Figure 7:
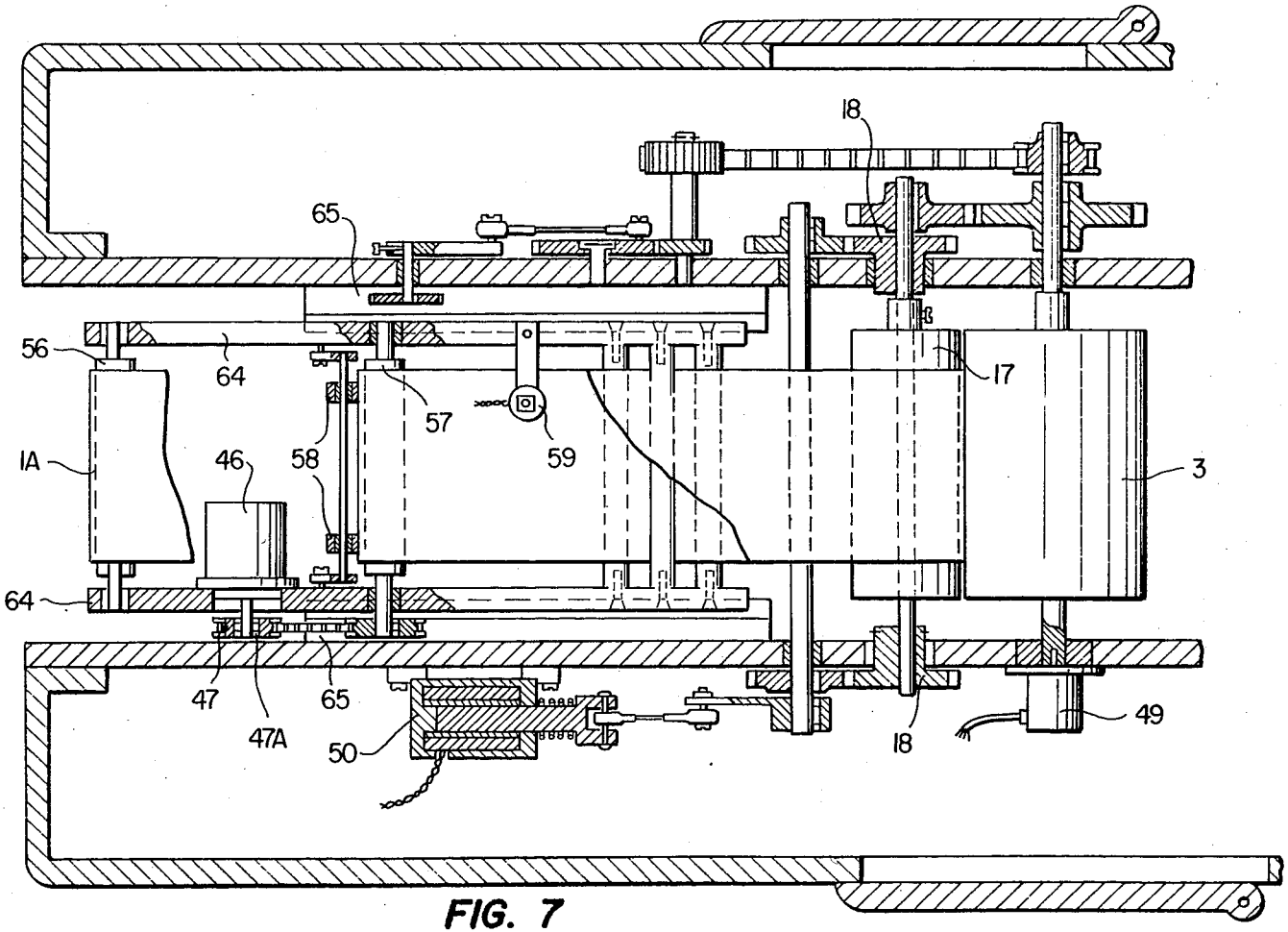

FIGS. 6 and 7 show, in front and plan view, an example of the machine set up for web-fed printing from reel to reel. The latter are carried on a run-off reel 52 (FIG. 6). The motor 53 drives the shaft of the reels by means of clutches for the control loops 54 and 55. The rolls 56 tighten and guide the web 1A. The press-cylinder 17 (FIG. 7) ensures the pressing of the web of paper against the blanket cylinder 3 by means of its eccentric bearings 18 (FIG. 7) set in rotation by the electromagnet 50 as in the previous case. A step motor 46 drives the roller 57 by means of a free wheel gear 47A. The pressure rollers 58 ensure driving of the web of paper 1A. At the starting signal of the printing cycle given by the pulse generator 49, the electronic casing 16 (FIG. 6) activates the electromagnet 50 (FIG. 7) and ensures pressure of the impression cylinder 17 when it is facing the hollow of the blanket cylinder 3. The step motor 46 turns in the direction of unwinding of the web, but at a speed substantially greater than that corresponding to the turning of the blanket cylinder 3. The step motor 46 starts up in the same free direction of the free wheel gear 47A and, for this reason, has no effect on the drive of the web of paper 1A. At each printing cycle, when the hollow of the blanket cylinder 3 is at the end of its unwinding and comes into contact with the press-cylinder 17, the web of paper 1A, gripped between the two, is drawn and printed. At the end of printing, with the programmed format, a set of orders are emitted by the electronic control casing 16 and follow each other at very short intervals set by retarders acting on:

(a) the ending of pressure of the press-cylinder 17 (FIG. 7). The electromagnet 50 is released and the web of paper 1A moves away from the blanket cylinder 5 which no longer drives it, (b) the stoppage of the step motor 46, (c) the rotation of the step motor 46 at a very slow speed, in the reverse direction. The free wheel gear 47A becomes active, the roller 57 turns and moves the paper back, (d) the stoppage of the step motor 46, obtained by the passage under the optical detector 59 of a line or a point serving as a mark and produced on the web during printing. The position of the optical detector 59 along the web of paper defining the printed format. Important variants of known means concerning the driving and feeding of the web can be applied without going beyond the scope of the present invention.

In the configuration in FIGS. 6 and 7, the machine makes it possible to successively carry out either sheet-fed printing or web-fed printing from reel to reel in 2 colors plus numbering. The configuration in FIGS. 3 and 4 makes it possible to simultaneously carry out sheet-fed and web-fed printing from reel to reel. In another form of the invention, an example of a removable device which can be fitted on existing sheet-fed presses to change them to mixed sheet-fed and web-fed presses, from the same basic components described in the present invention. According to the arrangement of the various components constituting the sheet-fed press to which it is attached, the results obtained will combine all or some of those achieved with the presses designed for this purpose and coming within the scope of the invention.

FIG. 8 shows a plan view of an example of a complete device fitted on a conventional sheet-fed offset press. The frame 60 fixed on the press by the adaptors 61 supports all the components necessary for operation of the device. The blanket cylinder 3 directly drives the impression cylinder 17. The eccentric shaft 62 makes it possible, by means of the rotation of the lever 24 activated by the electromagnet 50, to subject the web of paper 1 to pressure and print it. As in the previous example in FIG. 6, the combination of electronic casing 16, pulse generator 49 and step motor 46 permits displacement of the web of paper 1 and the appropriate positioning of the printing by means of the chain drives with pins 2. As in the examples in FIGS. 3 and 6, the web of paper 1 is returned into its folds by the folder 5 activated by the connecting rod 40 and the crank gear 39. Moreover, as in the example in FIG. 5, the system for driving the web of paper 1 can be achieved in a completely mechanical manner with cams and ratchet wheel.

These versatile presses, in their different versions, permit the following combinations:

(a) simultaneous sheet-fed and web-fed printing

1: sheet-fed printing in one color plus web-fed printing on one colors

2: sheet-fed printing in one color plus numbering plus web-fed printing in one color 3: sheet-fed printing in one color plus one support color plus web-fed printing in one color 4: sheet-fed printing in one color plus web-fed printing in one color plus one support color 5: sheet-fed printing in one color plus web-fed printing in one color plus numbering (b) web-fed printing
6: web-fed printing, fold to fold, in one color
7: web-fed printing, reel to reel, in one color
8: web-fed printing, fold to fold, in one color plus numbering
9: web-fed printing, reel to reel, in one color plus numbering
10: web-fed printing, fold to fold, in two colors
11: web-fed printing, reel to reel, in two colors
12: web-fed printing, fold to fold, in two colors plus numbering
13: web-fed printing, reel to reel, in two colors plus numbering
14: web-fed printing, fold to fold, in two colors plus one support color
15: web-fed printing, reel to reel, in two colors plus one support color
(c) sheet-fed printing
16: sheet-fed printing in one color
17: sheet-fed printing in one color plus numbering
18: sheet-fed printing in two colors
19: sheet-fed printing in two colors plus numbering
20: sheet-fed printing in two colors plus one support color.

The advantages obtained from these presses are evident and, by virtue of the fact that they eliminate constraints placed on traditional printers, they will allow considerable development in all web-fed printed matter of small and medium runs.

In parallel to the services which these versatile presses will offer traditional printers, it is envisaged that they will be used by specialized printers in web-fed printing, since, at present, computer manufacturers are developing appliances equipped with laser-printers, sheet-fed or web-fed depending on the intended use of the printed matter.

The device which can be fitted on the existing sheet-fed presses is not unimportant since, for a small investment, the printer can develop, within his company, these new markets before equipping himself with better adapted presses.

I claim:

1. An offset printer for the successive printing of single sheets and web sheets, comprising in combination:

a first plate cylinder having a plate with a first selected image formed thereon;

a first means for inking and damping said first plate cylinder with a first ink having a selected color, wherein a layer of first said ink is deposited on said first selected image;

a blanket cylinder for making selective circumferential contact with said first plate cylinder and picking up said layer of first ink deposited on said first selected image;

means for feeding single sheets in close physical proximity to said blanket cylinder;

a first impression cylinder for making selective circumferential contact with said blanket cylinder, urging said single sheets into contact with said blanket cylinder and causing the transfer of said layer of first ink from said blanket cylinder to said single sheets;

a second impression cylinder for making selective circumferential contact with said blanket cylinder;

means for driving said web sheets between said second impression cylinder and said blanket cylinder, wherein said layer of first ink on said blanket cylinder is transferred to said web sheets when said second impression cylinder makes circumferential contact with said blanket cylinder;

means for selecting between a single sheet mode of operation, and a web sheet mode of operation, wherein during said single sheet made of operation said second impression cylinder is removed from circumferential contact with said blanket cylinder, single sheets are fed between said blanket cylinder and said first impression cylinder by said means for feeding, and said first selected image is printed on said single sheets, and wherein during said web sheet mode of operation, the second impression cylinder is brought into circumferential contact with said blanket cylinder, said web sheets are advanced between said blanket cylinder and said second impression cylinder by said means for driving, and said first selected image is printed on said web sheets.

2. An apparatus according to claim 1, further comprising:

a second plate cylinder having a second plate with a second selected image formed thereon;

means for inking and damping said second plate cylinder with a second ink having a selected color, wherein a layer of said second ink is deposited on said second selected image, transferred from said second plate cylinder to said blanket cylinder when said second plate cylinder makes selective circumferential contact with said blanket cylinder, and deposited on said single sheet and web sheets.

3. An apparatus according to claim 1, further comprising:

a numbering cylinder disposed in close proximity to said first impression cylinder and said second impression cylinder;

means for inking and damping said numbering cylinder;

wherein during said web sheet made of operation said web sheets are advanced between said second impression cylinder and said numbering cylinder by said means for driving and are numbered by said numbering cylinder when said numbering cylinder makes selected circumferential contact with said second impression cylinder and wherein during said single sheet mode of operation single sheets are directed between said numbering cylinder and said first impression cylinder by said means for feeding and are numbered by said numbering cylinder when said numbering cylinder makes selective circumferential contact with said first impression cylinder.

4. An offset printer adapted for operation in two modes, first, for the simultaneous printing of single sheets and web sheets, and second, for the successive printing of single sheets and web sheets, comprising in combination:

a first plate cylinder having a plate with a first selected image formed thereon;

a first means for inking and damping said first plate cylinder with a selected first ink, wherein a layer of said first ink is deposited on said first selected image;

a second plate cylinder having a plate with a second selected image formed thereon;

a second means for inking and damping said second plate cylinder with a selected second ink, wherein a layer of said second ink is deposited on said second selected image;

a first blanket cylinder for making selective circumferential contact with said first plate cylinder and said second plate cylinder;

means for adjusting the position of the second plate cylinder relative to the first blanket cylinder;

a second blanket cylinder for making selective circumferential contact with said second plate cylinder during said simultaneous mode of operation, wherein said second blanket cylinder is removable from the apparatus during said successive printing mode of operation;

a first impression cylinder for making selective circumferential contact with said first blanket cylinder;

a second impression cylinder for making selective circumferential contact with said first blanket cylinder during said successive mode of operation, and for making selective contact with said second blanket cylinder during said simultaneous mode of operation;

means for adjusting the position of the second impression cylinder relative to the first blanket cylinder;

means for driving said web sheets around said second impression cylinder;

means for feeding said single sheets between said first blanket cylinder and said first impression cylinder;

wherein in said simultaneous printing mode of operation said second plate cylinder is adjusted out of contact with said first blanket cylinder by said means for adjusting the position of the second plate cylinder, said second impression cylinder is adjusted out of contact with said first blanket cylinder by said means for adjusting the position of the second impression cylinder, said second blanket cylinder is positioned between said second plate cylinder and said second impression cylinder, and said first selected image is transferred from said first plate cylinder via said first blanket cylinder to said single sheets as they are fed between "said first blanket cylinder and said first impression cylinder" and said second selected image is transferred via said second blanket cylinder to said web sheets as they are directed between said second blanket cylinder and said second impression cylinder by said means for driving; and wherein, during said successive printing mode of operation, said second blanket cylinder is removed, and in single sheet printing, said first selected image and said second selected image are transferred from said first plate cylinder and said second plate cylinder respectively onto said first blanket cylinder and imprinted on said single sheets as said single sheets are fed between said first impression cylinder and said first blanket cylinder by said means for feeding, and in web sheet printing, said first selected image and said second selected image are transferred from said first plate cylinder and said second plate cylinder respectively to said blanket cylinder and imprinted on said web sheets as said web sheets are advanced between said second impression cylinder and said first blanket cylinder.

* * * * *